US011852017B2

(12) United States Patent
Rapp

(10) Patent No.: US 11,852,017 B2
(45) Date of Patent: Dec. 26, 2023

(54) PISTON MACHINE, MODULAR CONSTRUCTION SYSTEM FOR A PISTON MACHINE, AND METHOD FOR PRODUCING A PISTON MACHINE

(71) Applicant: RapSon GmbH, Berlin (DE)

(72) Inventor: Manfred Max Rapp, Berlin (DE)

(73) Assignee: RAPSON GmbH, Berlin (DE)

( * ) Notice: Subject to any disclaimer, the term of this patent is extended or adjusted under 35 U.S.C. 154(b) by 0 days.

(21) Appl. No.: 17/279,281

(22) PCT Filed: Sep. 24, 2019

(86) PCT No.: PCT/EP2019/075661
§ 371 (c)(1),
(2) Date: Mar. 24, 2021

(87) PCT Pub. No.: WO2020/064706
PCT Pub. Date: Apr. 2, 2020

(65) Prior Publication Data

US 2022/0034226 A1 Feb. 3, 2022

(30) Foreign Application Priority Data

Sep. 24, 2018 (DE) ..... 10 2018 123 409.0

(51) Int. Cl.
*F01C 9/00* (2006.01)
*F01C 21/06* (2006.01)
*F04C 21/00* (2006.01)

(52) U.S. Cl.
CPC ..... *F01C 9/00* (2013.01); *F01C 9/002* (2013.01); *F01C 21/06* (2013.01); *F04C 21/002* (2013.01);
(Continued)

(58) Field of Classification Search
CPC ..... F01C 9/002
See application file for complete search history.

(56) References Cited

U.S. PATENT DOCUMENTS 367,872 A * 8/1887 Walters ..... F15B 11/16 91/177
1,969,620 A * 8/1934 Mau ..... F01C 1/20 418/196
(Continued)

FOREIGN PATENT DOCUMENTS

DE 19901110 A1 7/2000
DE 102008040574 B4 1/2010
(Continued)

OTHER PUBLICATIONS

EP 1843042 A1 machine translation to English from espacenet (Year: 2007).*
(Continued)

*Primary Examiner* — Kenneth Bomberg
*Assistant Examiner* — Michael Quandt
(74) *Attorney, Agent, or Firm* — FOX ROTHSCHILD LLP

(57) ABSTRACT

The invention relates to a modular construction system for a piston machine (100), comprising at least two separate housing parts capable of being joined together into a housing (1) of the piston machine (100), a piston (15) which is configured as a swivel element, is pivotable and is able to be arranged in the housing (1), and a housing cover (7) for covering the housing (1). The piston machine (100) is in particular configured as a modular construction system, the components of which are formed by multiple segments and joined together in a horizontal and a vertical direction in each case. The invention further relates to a piston machine (100) produced using the modular construction system and to a method for producing a piston machine (100).

10 Claims, 13 Drawing Sheets

Figure 1:
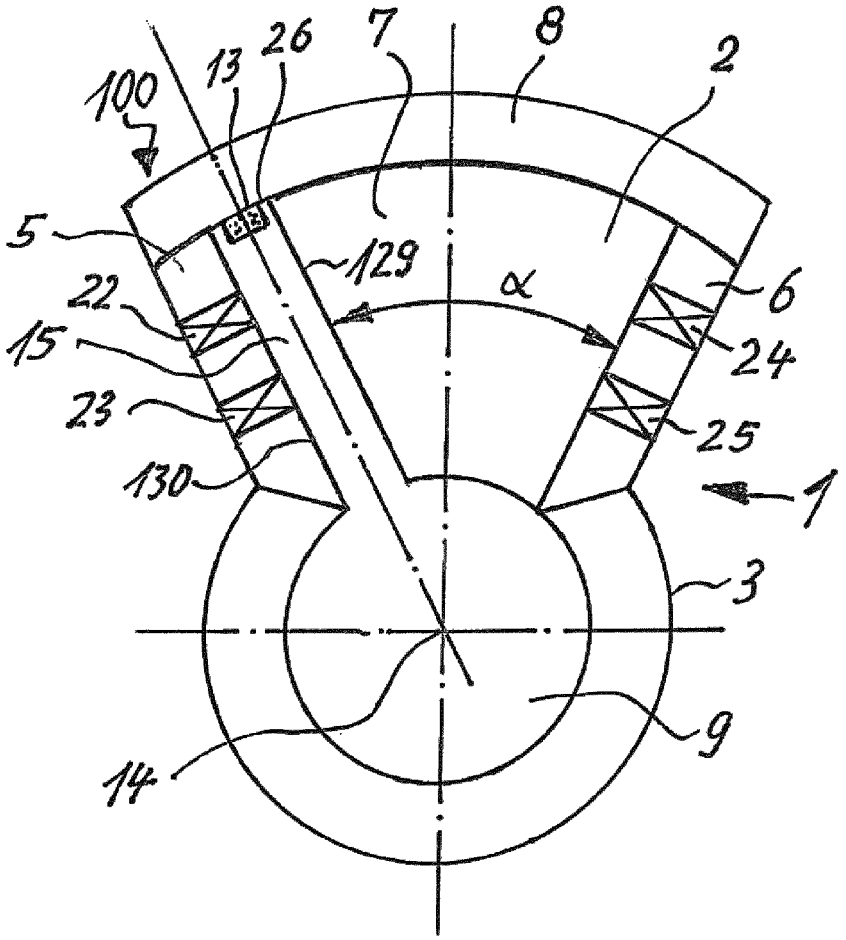

(52) U.S. Cl.
CPC ..... *F04C 2240/30* (2013.01); *F04C 2240/70* (2013.01)

(56) References Cited

U.S. PATENT DOCUMENTS 2,055,296 A * 9/1936 Lane ..... F01C 21/10 417/338
2,570,832 A * 10/1951 Mercier ..... F03C 4/00 92/67
3,289,544 A * 12/1966 Daniels ..... F15B 11/18 91/167 A
3,388,693 A 6/1968 Richard
3,408,991 A * 11/1968 Davis ..... F01C 9/002 123/18 R
3,945,348 A 3/1976 Balve
4,884,532 A 12/1989 Tan et al.
5,228,414 A 7/1993 Crawford
8,082,891 B2 * 12/2011 Von Stade ..... F01C 21/008 123/18 R
2013/0205990 A1 * 8/2013 Rapp ..... F01C 9/002 92/54
2017/0138359 A1 * 5/2017 Rapp ..... F04C 15/06

FOREIGN PATENT DOCUMENTS

DE 102010036977 B3 11/2011
DE 102014208939 A1 11/2015
DE 102014214435 A1 1/2016
DE 102016119985 B3 5/2018
EP 1843042 A1 * 10/2007 ..... F04C 9/002
GB 331545 A 7/1930
WO 2015173255 A1 11/2015

OTHER PUBLICATIONS

International Search Report mailed in PCT/EP2019/075661 dated Dec. 17, 2019.

* cited by examiner

PISTON MACHINE, MODULAR CONSTRUCTION SYSTEM FOR A PISTON MACHINE, AND METHOD FOR PRODUCING A PISTON MACHINE

CROSS-REFERENCE TO RELATED APPLICATIONS

This application is a § 371 national phase entry of International Patent Application No. PCT/EP2019/075661, filed on Sep. 24, 2019, which claims priority to and the benefit of German Patent Application No. 10 2018 123 409.0 filed on Sep. 24, 2018, both of which are hereby incorporated herein by reference in their entireties.

The invention relates to a piston machine having a multipart housing, to a modular construction system for a piston machine, and to a method for producing a piston machine using a modular construction system.

Compressors are known from the prior art, for example from DE 10 2010 036 977 B3, DE 10 2014 208 939 A1, DE 10 2008 040 574 B4, DE 10 2014 214 435 A1, WO 2015/173255 A1 and DE 199 01 110 A1.

In order to fulfill the demands of a specific application, there is a large number of compressors of different designs worldwide. Accordingly, the field of compressors includes, for example, reciprocating compressors, scroll-type compressors, rotary tooth compressors and screw-type compressors. Among said compressors, a distinction can also be made between oil-injected compressors and oil-free compressors. As a rule, each compressor type must be specifically constructed and developed for the corresponding application. Due to the precision adjustment in the conveying areas, several hundred compressor versions are necessary in the oil-injected area. There are also more than a hundred versions in the oil-free area. The large number of different compressors leads to high costs in research, development, production, warehousing and service overall. There is a similarly large diversity in pumps, compressed gas motors and expansion motors.

Accordingly, this invention addresses the problem of lowering the overall costs, e.g., production costs and service costs, and the production effort associated with compressors, pumps and/or motors.

This problem is solved by the piston machine according to the main claim. The problem is also solved by a method for producing the piston machine. The features of the dependent claims and of the exemplary embodiments give rise to advantageous developments.

According to one aspect of the invention, a piston machine is disclosed which comprises: a piston, which is mounted so that it is pivotable about a swivel axis in a working chamber having at least one inlet valve opening (preferably having one inlet valve) and at least one outlet valve opening (preferably having one outlet valve); the piston being operatively connected to at least one rotatably mounted shaft (preferably in such a way that the rotary movement of the shaft is converted into a swivel movement of the piston by means of a swivel lever); the working chamber being formed by a plurality of housing parts; the working chamber being delimited with respect to the swivel axis by at least two separate side walls.

According to an embodiment variant, at least two separate side walls are arranged axially in sequence.

According to an embodiment variant, the piston machine is configured as an oscillating piston machine.

According to an embodiment variant, provision is made of two pistons which form a common working chamber; the two pistons being configured so that they are pivotable between a first position, in which the pistons are arranged at a minimum distance to each other yet without contact (preferably having a clearance of between (preferably ca.) 1/100 and 5/100 mm at operating temperature), and a second position, in which the pistons are at a maximum distance from each other; the pistons being (preferably permanently) offset by 180° in both positions. This is advantageous in that a low-vibration or vibration-free operation is thus possible.

According to an embodiment variant, provision is made of two pistons which form a common working chamber; the two pistons being configured so that they are pivotable between a first position, in which the pistons are arranged at a minimum distance to each other yet without contact (preferably having a clearance of between (preferably ca.) 1/100 and 5/100 mm at operating temperature), and a second position, in which the pistons are at a maximum distance from each other; the pistons being (preferably permanently) offset by 180° in both positions. Preference is given to providing at least one cooling aperture, although at least two cooling apertures are preferred, in the common working chamber in such a way that the two cooling apertures are open in the second position. The two cooling apertures are preferably closed in the first position.

According to an embodiment variant, provision is made of three pistons and of three cooling apertures assigned to the respective pistons, wherein a first piston and a second piston are arranged in a first position at a minimum distance to each other, yet without contact (preferably having a clearance of between (preferably ca.) 1/100 and 5/100 mm at operating temperature), whereas a third piston is arranged at a maximum distance from the second piston in the first position, wherein the second piston and the third piston are arranged in a second position at a minimum distance to each other, yet without contact (preferably having a clearance of between (preferably ca.) 1/100 and 5/100 mm at operating temperature), whereas the first piston is arranged at a maximum distance from the second piston in the second position.

The cooling aperture assigned to the first piston is preferably closed in the first position, whereas the cooling aperture assigned to the second piston and the cooling aperture assigned to the third piston are open; the cooling aperture assigned to the third piston being closed in the second position, whereas the cooling aperture assigned to the second position and the cooling aperture assigned to the first piston are open.

According to an embodiment variant, at least two separate side walls are identically constructed. According to an embodiment variant, at least all side walls are identically constructed.

According to an embodiment variant, the at least one working chamber is delimited along the swivel axis of the piston by an end wall and a cover.

According to an embodiment variant, the working chamber is delimited transversely with respect to the swivel axis by a bearing shell, two separate side walls and a arcuate side wall.

According to an embodiment variant, the side walls delimiting the working chamber transversely with respect to the swivel axis are each formed by a plurality of identical housing parts, which are each arranged axially in sequence.

According to an embodiment variant, the at least two separate side walls are detachably interconnected.

According to an embodiment variant, the at least two separate side walls are arranged symmetrically with respect to a plane extending perpendicular to the swivel plane and along the longitudinal axis of the at least one piston in a neutral position.

According to an embodiment variant, all housing parts are arranged symmetrically with respect to a plane extending perpendicular to the swivel plane and along the longitudinal axis of the piston in a neutral position.

The modular construction system for a piston machine comprises

- at least two separate housing parts capable of being joined into a housing of the piston machine,
- a piston, which is configured as a swivel element, is pivotable, and is able to be arranged in the housing, and
- a housing cover for covering the housing.

In this context, "separate" means in particular that prior to the assembly of the housing parts into a housing, individual housing parts are present which are able to be joined together and/or interconnected to form the housing of the piston machine. Accordingly, in particular a piston machine of modular design can be produced using the modular construction system. The separate housing parts can be produced with considerably less effort than can a single-piece, complete housing, which entails a considerable cost reduction. Moreover, individual housing parts can be replaced or combined as necessary, for example if one or more housing parts or piston parts (see below) are damaged during the operation of the piston machine. Also, the individual housing parts or piston parts can each be adapted or optimized during the construction of the housing, without having to produce a completely new housing each time.

A piston machine produced using the modular construction system according to claim 1 is thus characterized by its modular design and can be assembled in the manner of a kit. Overall, costs and effort for construction, production, storage, distribution, maintenance and repairs can be considerably lowered by the modular design of the piston machine.

The piston can likewise have at least two separate piston parts. The piston can have, for example, piston parts that is able to be arranged axially in sequence. As an alternative or in addition, the piston can also have multiple piston parts which can attach to one another in a radial direction. The separate piston parts can be interconnectable. The piston can be fastenable to a rotary cylinder. The rotary cylinder can likewise have multiple rotary cylinder discs, which are able to be connected in sequence. In one embodiment, the "piston-rotary cylinder" system comprises multiple integral axial discs.

Providing multiple piston parts and multiple housing parts makes it possible to vary a working volume or chamber volume of the piston machine without having to construct or develop a completely new piston machine for this purpose. Accordingly, a chamber volume or working volume of an existing piston machine can be enlarged or reduced as needed, without having to produce a new piston machine.

A basic version of the modular construction system can be defined by a specific size of the end wall and of the housing cover. By varying the number of housing parts and piston parts between the end wall and the housing cover, it is possible to cover a large portion of the market for piston machines with a relatively small number of basic versions of the modular construction system (e.g., 9 or fewer) it is possible to cover a large portion of the market with just one machine type, whereas multiple different machine types (e.g., reciprocating, scroll-type, rotary tooth and screw-type compressors) and several hundred versions are needed in the prior art.

The number of housing parts is preferably greater than the number of piston parts.

In each case, adjacent (permanently, but releasably fixed) housing parts preferably contact one another directly. The respective contact surfaces of the housing parts are preferably (entirely) planar in configuration.

The piston machine is preferably configured as an oscillating piston machine. Further preference is given to configuring the piston machine as an oscillating piston compressor.

A swivel axis of the piston defines an axial direction in the following. In one design, the individual housing parts is able to be arranged axially in sequence. Additionally or alternatively, the piston parts is able to be arranged axially in sequence. In this context, the term "is able to be arranged axially in sequence" means that the components is able to be arranged axially in sequence in the longitudinal direction of the swivel axis. The term "is able to be arranged axially adjacent to one another" means that the components have the same axial position relative to the piston machine and, for example, lie in the same swivel plane, the swivel plane being spanned by a swivel movement of the piston and oriented perpendicularly to the swivel axis.

The modular construction system typically comprises one or several or all of the following housing parts:

- an end wall opposite the housing cover,
- a arcuate wall,
- a first bearing shell opposite the arcuate wall for mounting the piston, and/or
- at least one side wall, which delimits a swivel angle of the piston, for example two opposite side walls which delimit the swivel angle of the piston.

According to the invention, it is preferred if the (at least one) working chamber of the piston machine is delimited on a front side, in relation to the swivel axis of the piston, by a housing cover and on the back side by an end wall. In addition, the (at least one) working chamber of the piston machine is delimited on a top side, in relation to the swivel axis of the piston, by a arcuate wall and on a bottom side by a bearing shell. The sides of the (at least one) working chamber which extend between the housing cover and the end wall are delimited by opposite side walls.

According to the invention, it is preferred if one or several or all of the following housing parts:

- housing cover
- end wall,
- arcuate wall,
- bearing shell and/or
- at least one side wall, are divided horizontally and/or vertically, i.e., said components are made of multiple segments, which extend transversely and/or longitudinally in their respective extension directions.

In the case of a housing cover and an end wall, this means that in each case multiple segments of these components extend along a vertical direction between a bearing shell and a arcuate wall and/or along a horizontal direction between a first (left) side wall and a second (right) side wall.

In the case of a bearing shell and a arcuate wall, this means that in each case multiple segments of these components extend along an axial direction along the swivel axis and/or along a horizontal direction between a first (left) side wall and a second (right) side wall.

In the case of the side walls, this means that in each case multiple segments of these components extend along an axial direction along the swivel axis and/or along a vertical direction between a bearing shell and a arcuate wall.

The preferred number of segments of said components is between 2 and 10, more preferably between 3 and 5.

The number of segments of said components along one of the three directions (axial, vertical, horizontal) is preferably equal in each case.

In the case in which the piston machine has multiple working chambers, according to the invention it is preferred if each of the working chambers is delimited by at least two separate segments of (at least one, preferably all) of the aforementioned components, which are arranged axially in sequence in each case.

In the case in which the piston machine has multiple working chambers, according to the invention it is additionally or alternatively preferred if each of the working chambers is delimited by at least two separate segments of (at least one, preferably all) of the aforementioned components, which are arranged horizontally in sequence in each case.

In the case in which the piston machine has multiple working chambers, according to the invention it is additionally or alternatively preferred if each of the working chambers is delimited by at least two separate segments of (at least one, preferably all) of the aforementioned components, which are arranged vertically in sequence in each case.

In the case in which the piston machine has just one working chamber, according to the invention it is preferred if this working chamber is delimited by at least two separate segments of (at least one, preferably all) of the aforementioned components, which are arranged axially in sequence.

In the case in which the piston machine has just one working chamber, according to the invention it is additionally or alternatively preferred if this working chamber is delimited by at least two separate segments of (at least one, preferably all) of the aforementioned components, which are arranged horizontally in sequence.

In the case in which the piston machine has just one working chamber, according to the invention it is additionally or alternatively preferred if this working chamber is delimited by at least two separate segments of (at least one, preferably all) of the aforementioned components, which are arranged vertically in sequence.

At least two of the above-mentioned separate housing parts can be interconnectable. After the housing parts are joined, the housing of the piston machine produced using the modular construction system generally comprises one or several or all of the aforementioned housing parts. In this document, the term "housing part" can be construed as one, several, or all of the above-mentioned housing parts. In this document, the separate housing cover is not considered as part of the housing.

Depending on the application case, individual or all housing parts can be made of a metal, a ceramic material, and/or a plastic or a combination of the aforementioned. Depending on the use of the piston machine, individual or all piston parts can be made of a metal, a ceramic material or a plastic or a combination of metal and/or ceramic material and/or plastic.

The end wall and the housing cover are typically able to be oriented parallel to each other. The side walls, if provided, can generally be arranged at angles to each other, in a manner corresponding to a swivel angle of the piston.

The arcuate wall, the at least one side wall and/or the bearing shell can typically be arranged axially between the housing cover and the end wall of the housing.

In one embodiment, at least one housing part is able to be arranged between the housing cover and the end wall. Provision can be made such that a single, integral housing part is able to be arranged between the housing cover and the end wall. This integral housing part can form, e.g., the arcuate wall, one or two side walls and/or the bearing shell. In another embodiment, at least two separate housing parts is able to be arranged between the housing cover and the end wall.

For example, the arcuate wall has at least two separate, preferably interconnectable wall parts. The wall parts of the arcuate wall are capable of being arranged axially in sequence and/or axially adjacent to one another.

The bearing shell optionally comprises at least two separate, preferably interconnectable bearing shell parts. The bearing shell parts can typically be arranged axially in sequence.

In one variant, the at least one side wall comprises at least two separate, preferably interconnectable side wall parts. The side wall parts is able to be arranged axially in sequence.

If several of the aforementioned components are arranged axially in sequence, a size of the piston machine can be varied in an axial direction. The housing parts and/or the piston parts can thus be arranged after one another in the manner of discs. In this case, the housing parts and the piston parts can be called housing discs and piston discs, respectively. The end wall of the housing and the housing cover can remain the same as the housing is enlarged or reduced axially, for example if multiple piston parts are connected axially in sequence. In this case, an equal number of wall parts, an equal number of bearing shell parts, and an equal number of side wall parts can be connected axially in sequence in the longitudinal direction of the swivel axis of the piston.

In this manner, the piston machine produced using the modular construction system can thus have a single end wall, N piston parts, N wall parts of the arcuate wall, N bearing shell parts and/or N side wall parts, N being a positive integer greater than or equal to two. For example, N can be equal to 2, 3, 4, 5, 6, 7, 8, 9, 10 or even more. In addition, provision can be made of a single housing cover. The end wall and/or the housing cover can also be in multi-part form. In one embodiment, at least two of the above-mentioned components (piston parts or housing parts) can be identical in construction. In another embodiment, the piston parts, the wall parts of the arcuate wall, the bearing shell parts and/or the side wall parts have identical or different dimensions in an axial direction. The modular construction system can therefore comprise different components of the same or different dimensions in an axial direction.

The modular construction system can also comprise a single-part or multi-part gearbox housing. In one embodiment, the gearbox housing is able to be arranged in abutment on the end wall and can be connected to the end wall.

In one embodiment, the modular construction system has means for fixing, joining and/or fastening the housing parts and/or piston parts. For example, the housing parts and/or the piston parts can be interconnected by means of a tongue-and-groove joint, pins such as, for example, fixing pins, retaining pins. In addition or as an alternative to said connection methods, the piston parts and/or the housing parts can be welded, bonded, or soldered together. To this end, designated welding points, bonding points or soldering points can be provided for the piston parts and/or housing parts. The means for fixing, joining and/or fastening the housing parts and/or piston parts are preferably configured as means for the reversible fixing or reversible joining or reversible fastening of the housing parts and/or piston parts. This is advantageous in that a piston machine according to the invention can be particularly easily retrofitted (modified) in terms of its design (e.g., size of the chambers).

Particular preference is given to (all of) the housing parts and/or the piston parts being interconnected in such a way that the housing parts (piston parts) are interconnected in a permanent yet reversibly detachable manner. This means that the connection can be released reversibly in such a way that the housing parts (piston parts) and in particular the contact surfaces thereof remain unaltered and can therefore be reused.

In one design, the modular construction system comprises at least one further second piston, which is configured as a swivel element, is pivotable, and capable of being arranged in the housing. Details on multi-piston piston machines are disclosed in, for example, DE 10 2010 036 977 B3. In this case the modular construction system, or rather the housing of the piston machine, can have a second arcuate wall and a second bearing shell opposite the second arcuate wall for mounting the second piston.

The modular design of the piston machine makes it possible to design different working chambers within a single piston machine. In one embodiment, the housing has a dedicated working chamber for each piston, wherein at least two working chambers have different or identical dimensions/volumes and/or different or identical functions. Examples of possible functions of the working chambers include compressor, pump or motor. Whereas one working chamber of the piston machine is thus designed as a compressor, another working chamber of the piston machine can operate as, e.g., a pump. Furthermore, different compressor or pump stages can be provided by having different working chambers in a single piston machine.

The second arcuate wall and the bearing shell can be configured as, e.g., a first chamber head section. The second bearing shell and the arcuate wall are optionally configured as a second chamber head section. The first chamber head section and the second chamber head section can each have the same shape or can each have a different shape. The chamber head section can comprise multiple integrally formed segments (discs), which are arranged axially in sequence.

As an alternative, the arcuate wall, the bearing shell, the second arcuate wall and the second bearing shell can each be configured as separate housing parts.

The modular construction system can have a drive or output for the piston machine, which can be connectable to the piston, for example via a shaft. A person skilled in the art is aware that there are many possibilities for the construction of the drive or of the output. The invention is therefore not limited to a specific drive or output.

This invention furthermore proposes a piston machine which is produced using this modular construction system. In one embodiment, the piston machine comprises at least one component which can be replaced by an identical component. Accordingly, if it turns out that a component of the piston machine is damaged, this component can be replaced with an identical component with the aid of the modular construction system.

The housing can have at least one cooling aperture for the convective cooling of the piston by means of a coolant fluid. Depending on the application or need, the cooling aperture can be provided at different places of the housing. In one embodiment, the cooling aperture is an opening such as a gap, which is formed between two separate housing parts. In order to form the cooling aperture, the housing parts can be at least partially spaced apart from each other. Accordingly, the cooling aperture can be formed by, e.g., a gap between two wall parts or side wall parts which are spaced apart from each other. The cooling aperture can also be formed by omitting certain housing parts, wall parts or side wall parts, for example by omitting one of the side walls or by omitting both side walls. As an alternative or in addition, the cooling aperture can also be provided in one of said housing parts. For example, a bore in the corresponding housing part would be a possibility in this case. For example, the cooling aperture can be provided in the arcuate wall, in the end wall and/or in the at least one side wall. As an alternative or in addition, the cooling aperture can also be provided in the housing cover or in the end wall. The cooling aperture typically differs from any inlet valves or outlet valves. Persons skilled in the art can infer further details on possible cooling apertures from publication WO 2015/173255 A1.

The aforementioned piston machine can be used as a working machine in the form of a reciprocating pump and a piston-type compressor or as a power machine in the form of a compressed-gas motor or hydraulic motor for converting pressure generated by the working chamber into motion. In addition, the piston machine permits essentially oil-free operation, which is particularly desirable for a use as a vacuum pump, water pump or compressor.

The piston machine according to the invention is preferably configured as an oil-free piston machine. In the sense of this invention, oil-free means that (all of) the moving parts of the piston machine are oil-free.

Reference is made to the statements above concerning the modular construction system for the characteristics of the piston parts and of the housing parts of the piston machine. Features that were only mentioned with reference to the modular construction system described above can also be claimed for the piston machine and vice versa.

According to the invention, it is possible to provide several drive possibilities, for example a loop drive in the piston or separately in the gearbox of the swivel lever, or a drive with a crankshaft connected to the swivel lever via a connecting rod, etc.

According to the invention, it is possible for the piston machine to operate with prelubricated roller bearings, without contact to the piston or running surfaces and basically oil-free and without gasketing. The pistons run in a contact-free manner in the chamber.

According to the invention, it is possible not to provide a cam piece, wherein the chamber housing can be of multipart design (multiple segments per component) in all places. The pistons can likewise be of multipart design laterally (horizontally) and in height (vertically) (complete modular construction system).

According to the invention, it is possible for the pistons to operate without running surfaces and also not to be guided by a cam piece. The pistons preferably operate in a contact-free and oil-free manner.

According to the invention, in the case of two or more pistons it is possible not to provide rolling engagement and gear toothing. The pistons operate without contacting the other pistons and also without contacting the chamber walls; hence oil-free operation is possible.

According to the invention, the piston machine can be configured as a 2-cycle system with intake and compression (on each side of the pistons). The piston machine is configured to execute two power strokes in a 360° turn of the crankshaft.

A method for producing a piston machine is also proposed with this invention.

The method comprises at least the following steps:

Provision of the modular construction system described in the preceding,

Joining of said housing parts into a housing,

Insertion of the piston in the housing,

Closing of the housing by means of the housing cover, and

Construction of the piston machine.

When multiple piston parts are provided, the piston parts are arranged in the housing. The piston, which is configured as a swivel element, is pivotable and arranged in the housing, can then be formed by the piston parts. The piston parts can also be assembled into the piston outside the housing. The piston can then be inserted in the housing.

For the characteristics of the piston parts and of the housing parts, reference is made to the statements above regarding the modular construction system and/or the piston machine. Features that were only mentioned with regard to the modular construction system described above or to the piston machine described above can also be claimed for the method for producing the piston machine and vice versa.

Overall, a number of advantages over the single-piece piston machine housings of the prior art arise due to the modularity of the construction system:

lower development or business process costs reduction of coordination and communication costs;

flexibility in product and organizational development;

faster product cycles and greater adaptability: if various compatible modules that can be installed, removed, changed or regrouped are available for adapting the system to new conditions. In contrast, such adaptations are usually only achievable in the form of costly restructuring with a single-piece piston machine.

Flexibility in offerings, greater product variety;

With multi-chamber versions, different applications (e.g., as a compressor pump, vacuum pump, hydraulic pump or water pump) can be used simultaneously with one machine; wherein instead of an electric motor, one of the chambers acting as a compressed-gas motor can drive these applications;

as a compressor, wherein multistage compression in a housing is possible;

less expensive production due to identical series and simpler assembly processes; and economical repair by replacing the defective component.

Figure 3A:
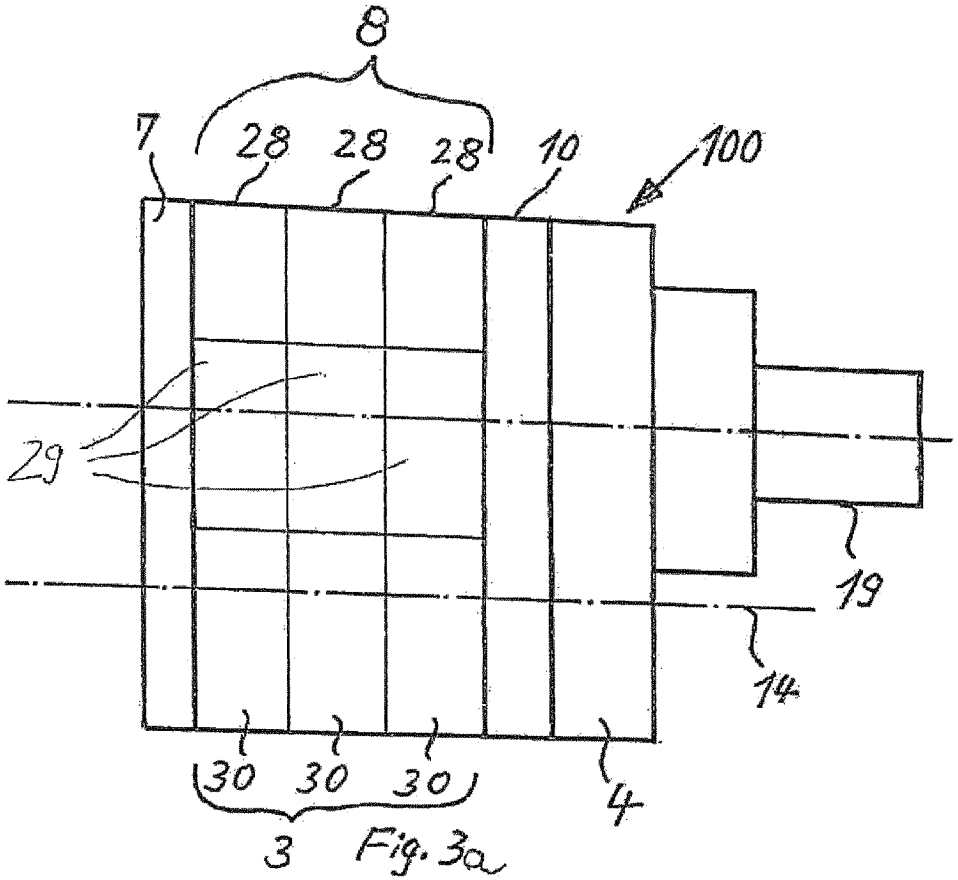
Figure 2:
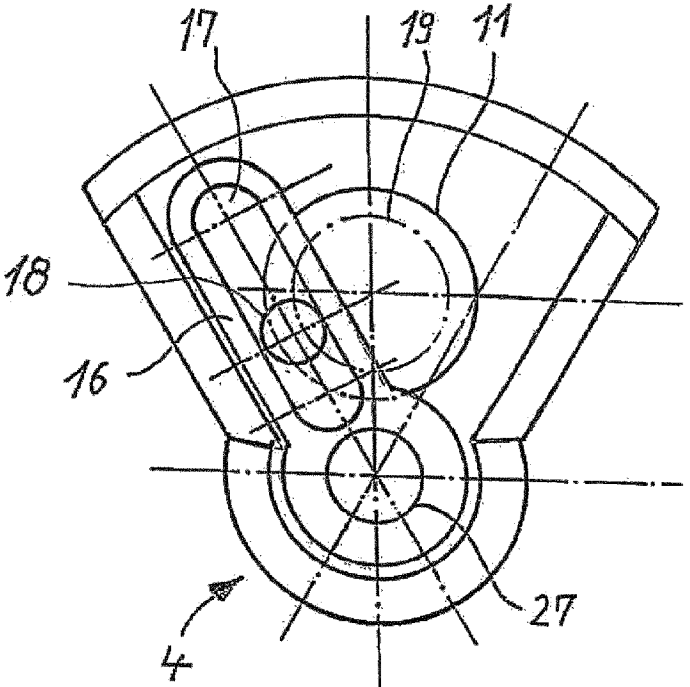
Figure 3B:
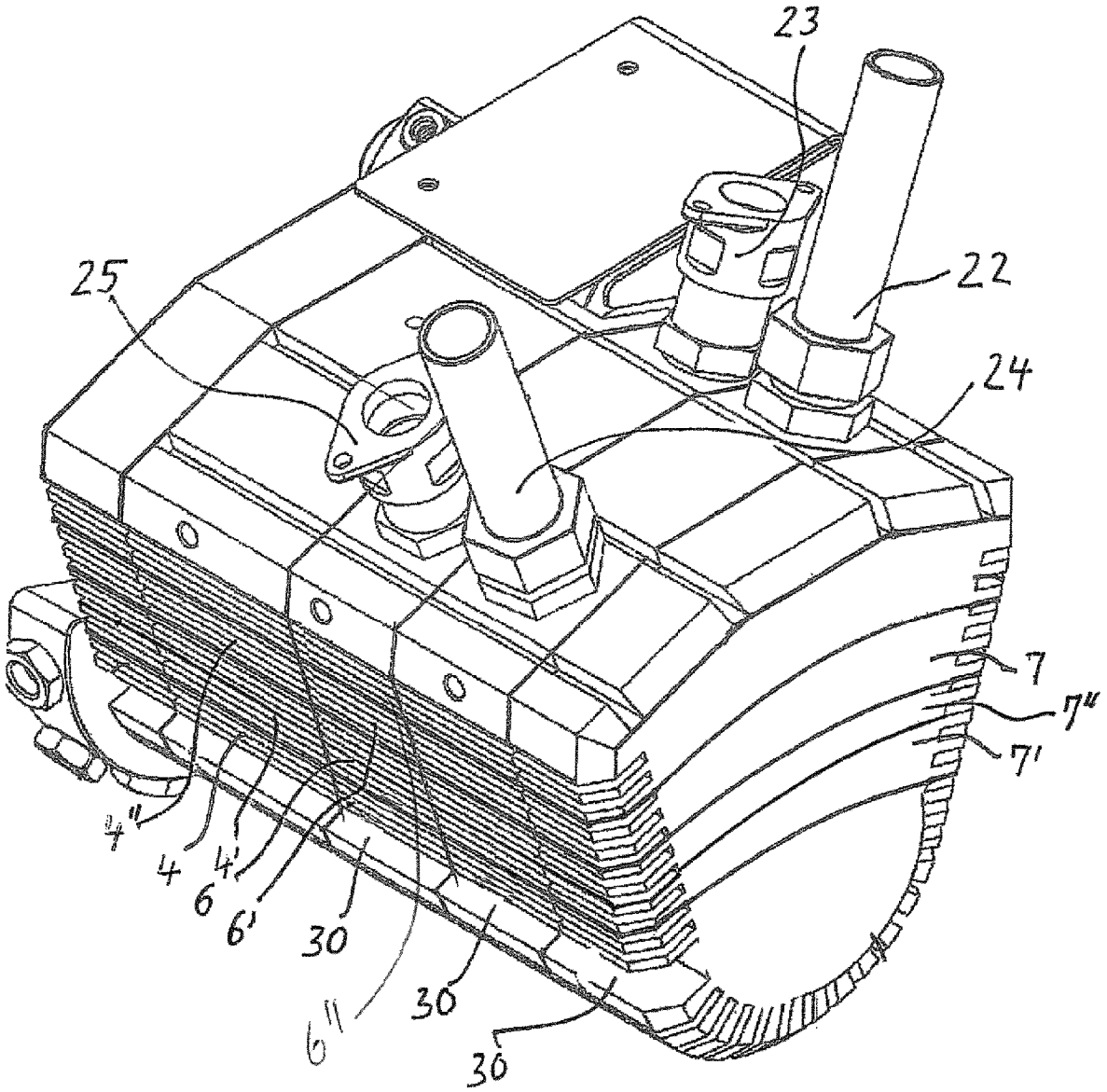
Figure 3C:
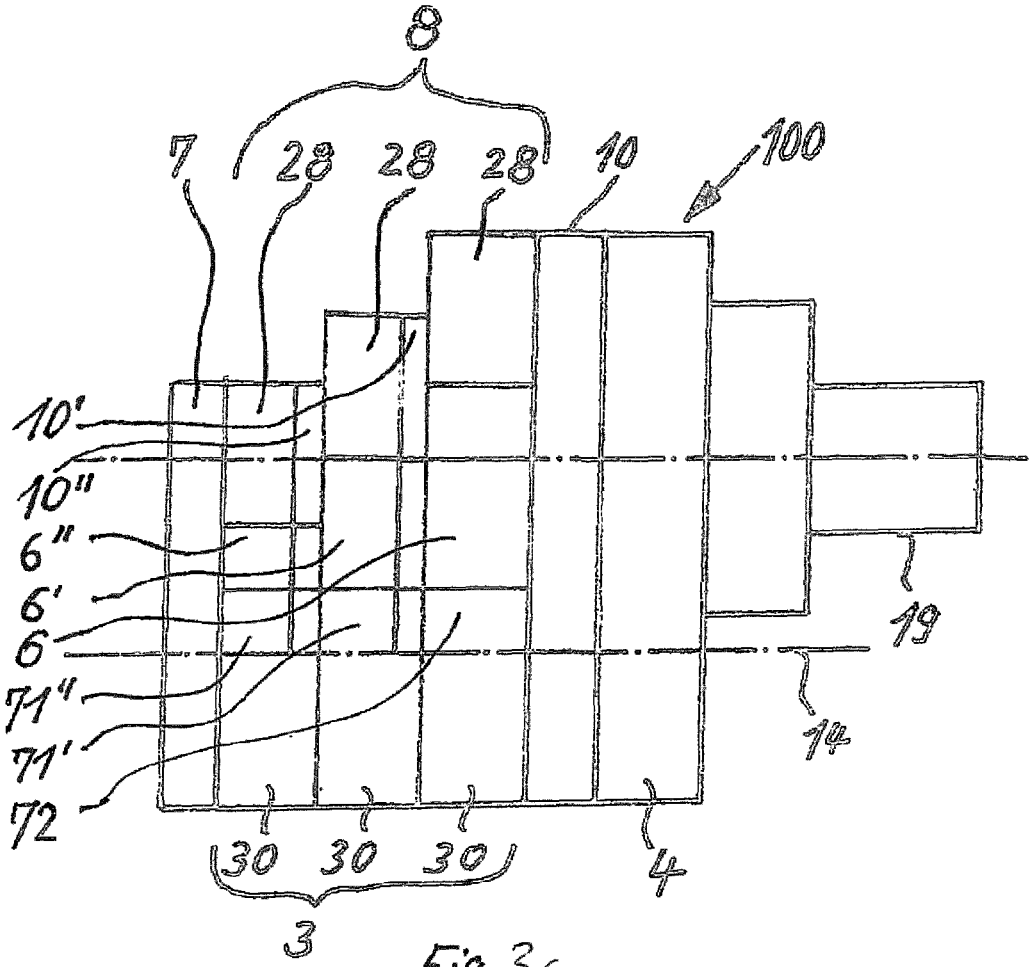
Figure 4:
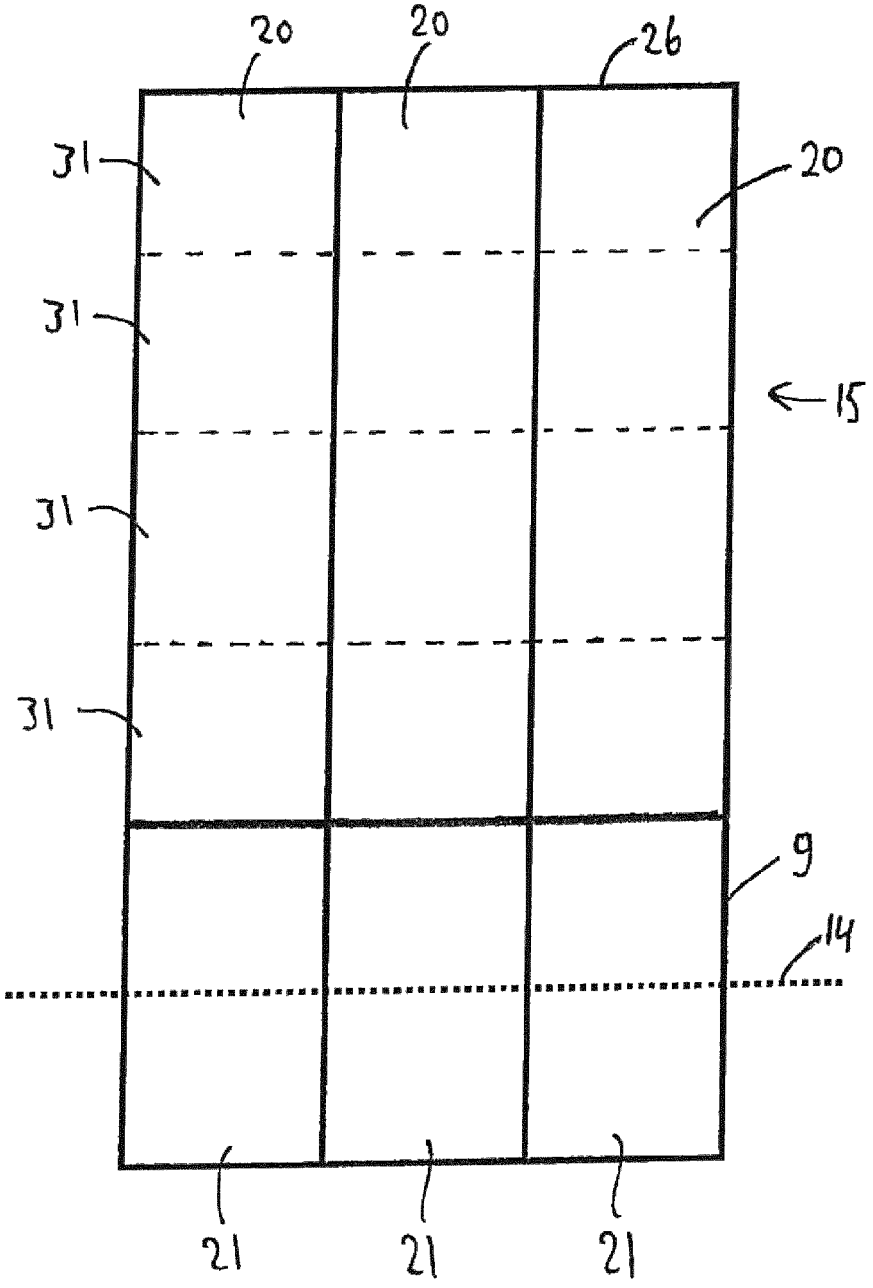
Figure 5:
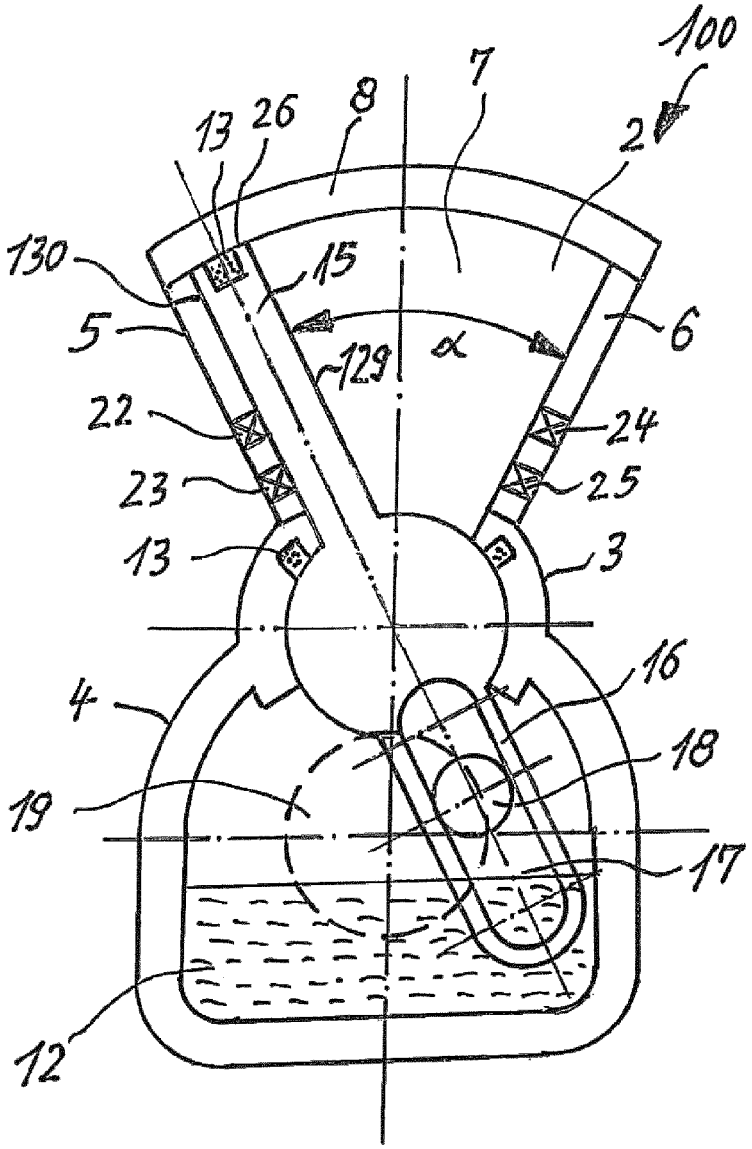
Figure 6:
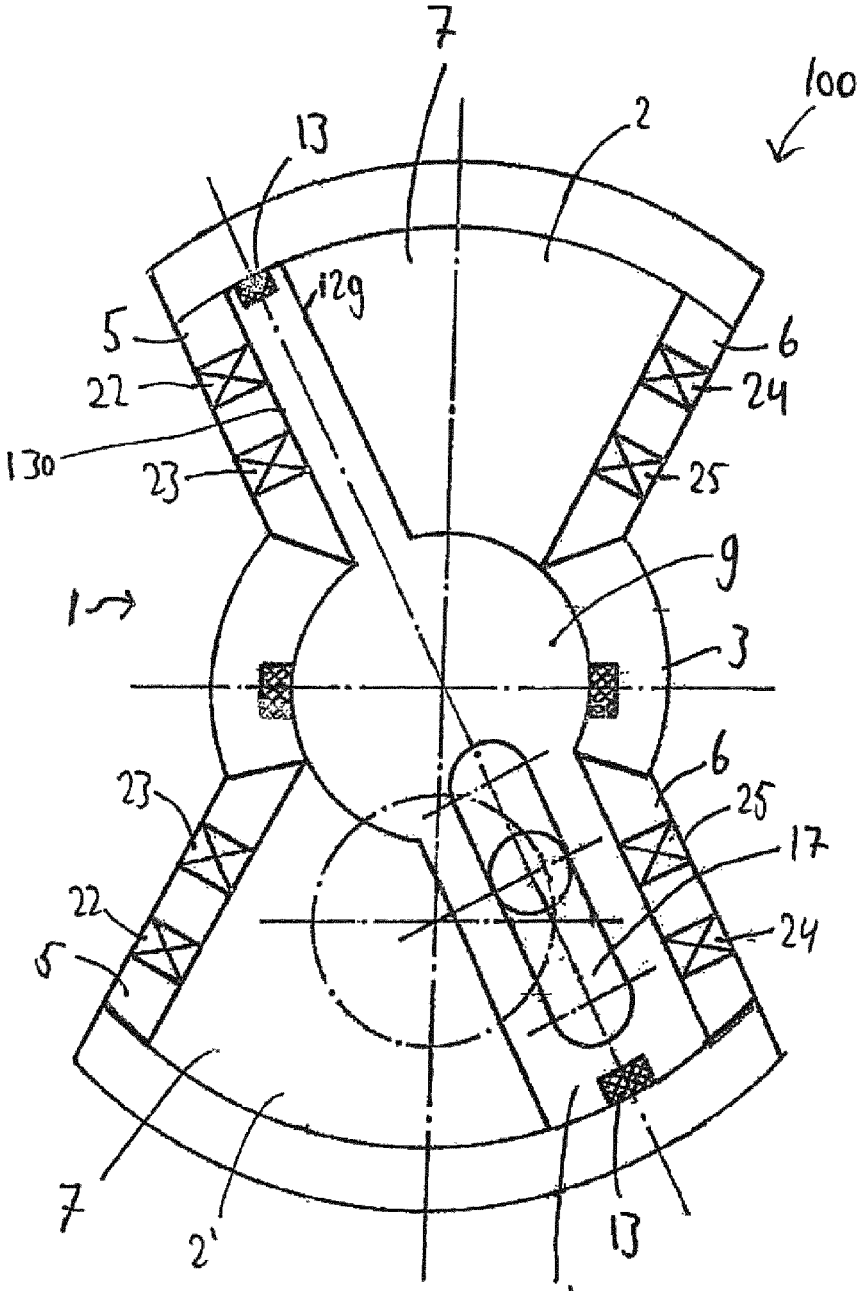
Figure 7:
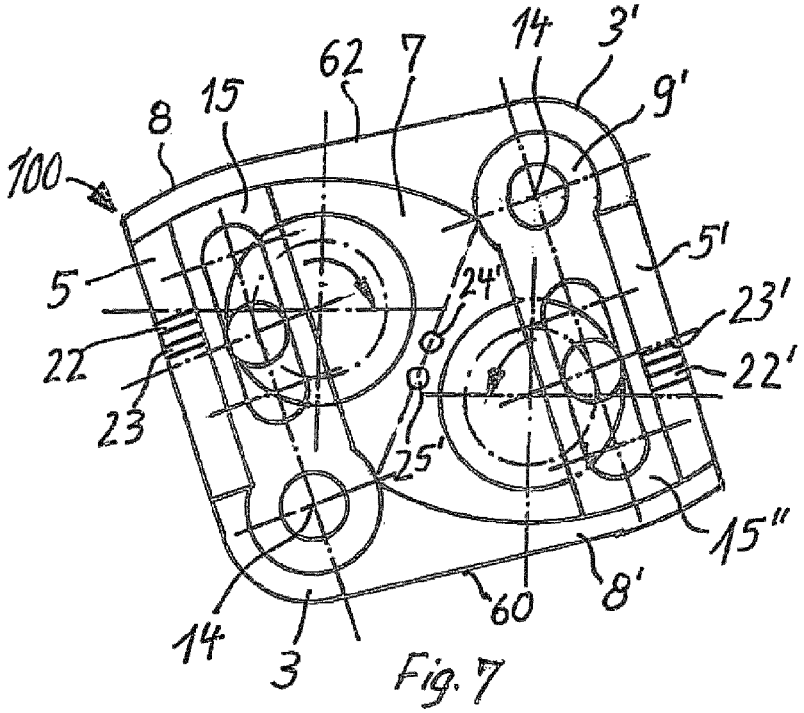
Figure 8:
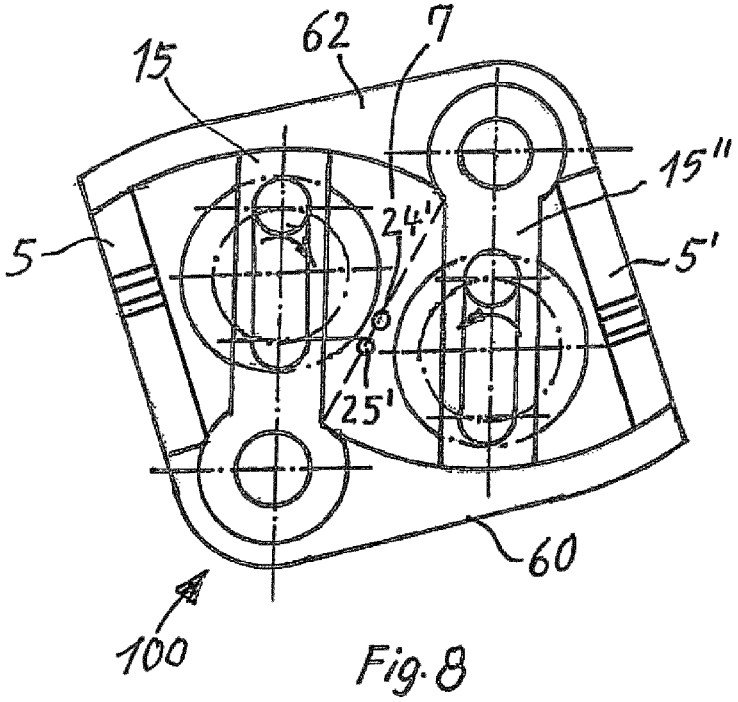
Figure 9:
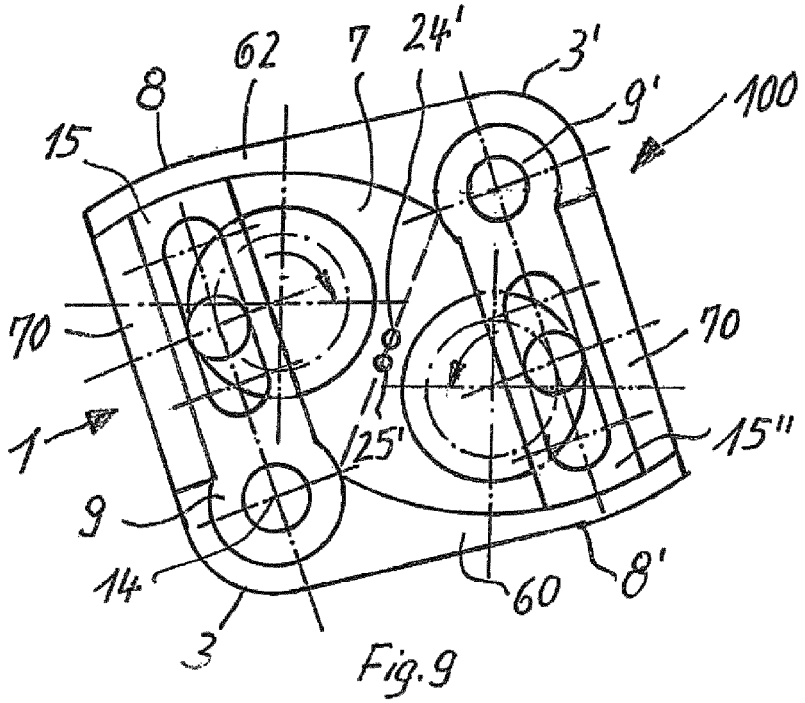
Figure 10:
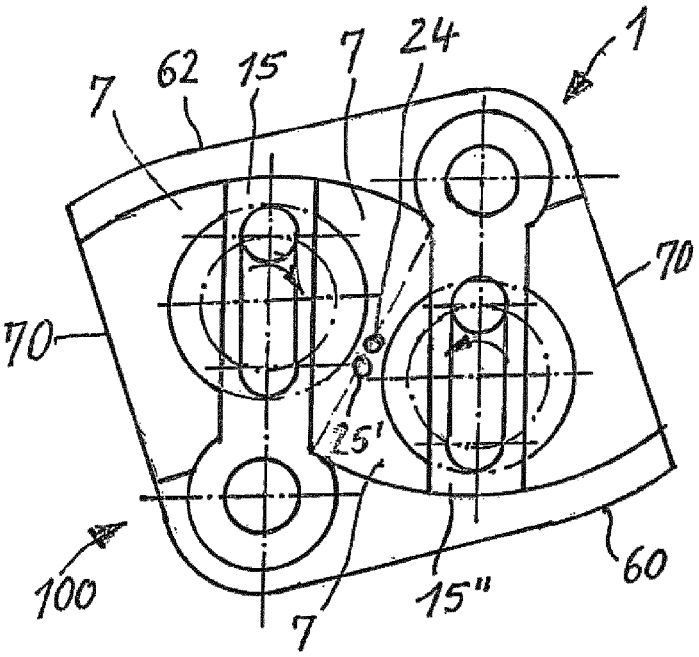
Figure 11:
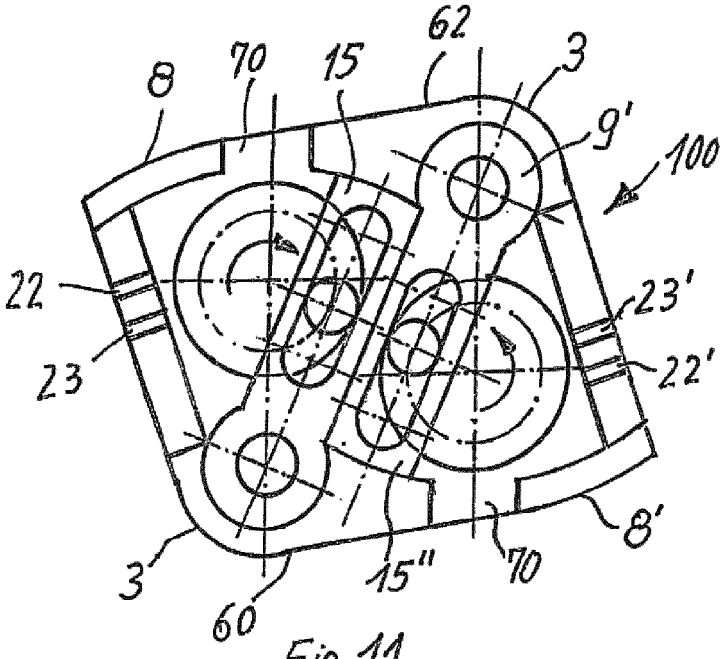
Figure 12A:
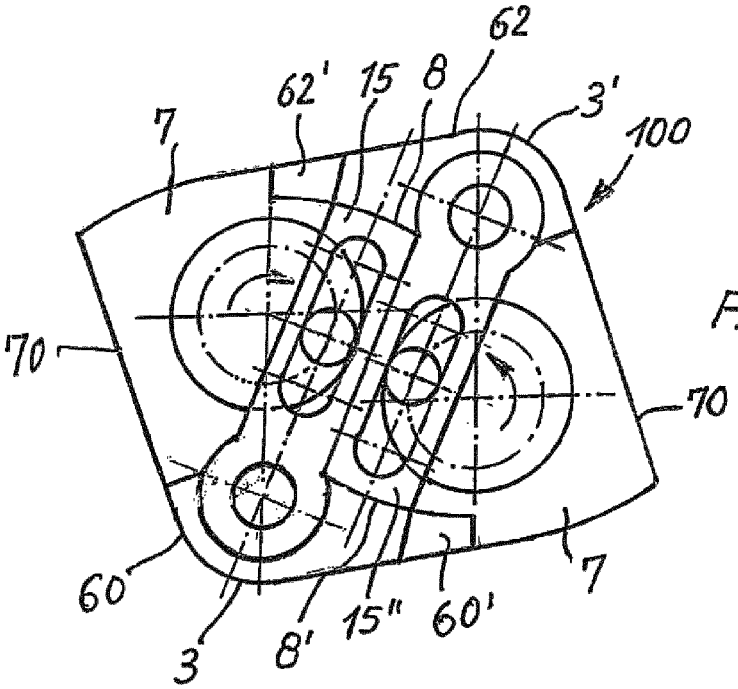
Figure 12B:
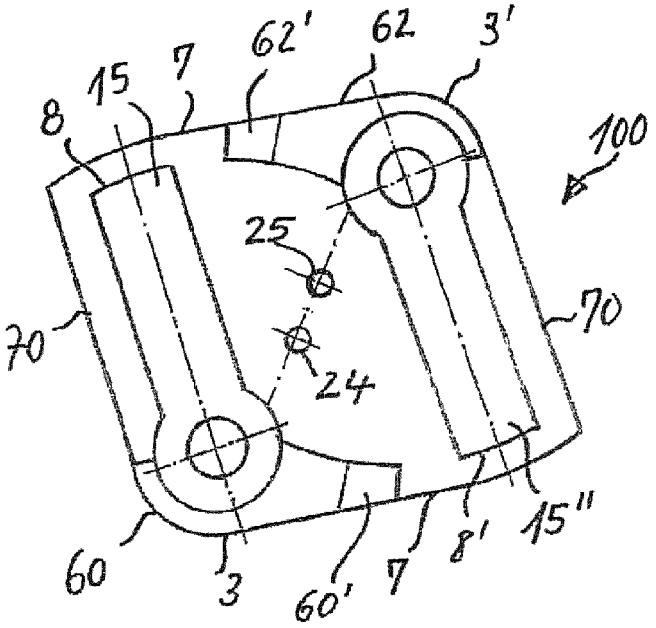
Figure 13:
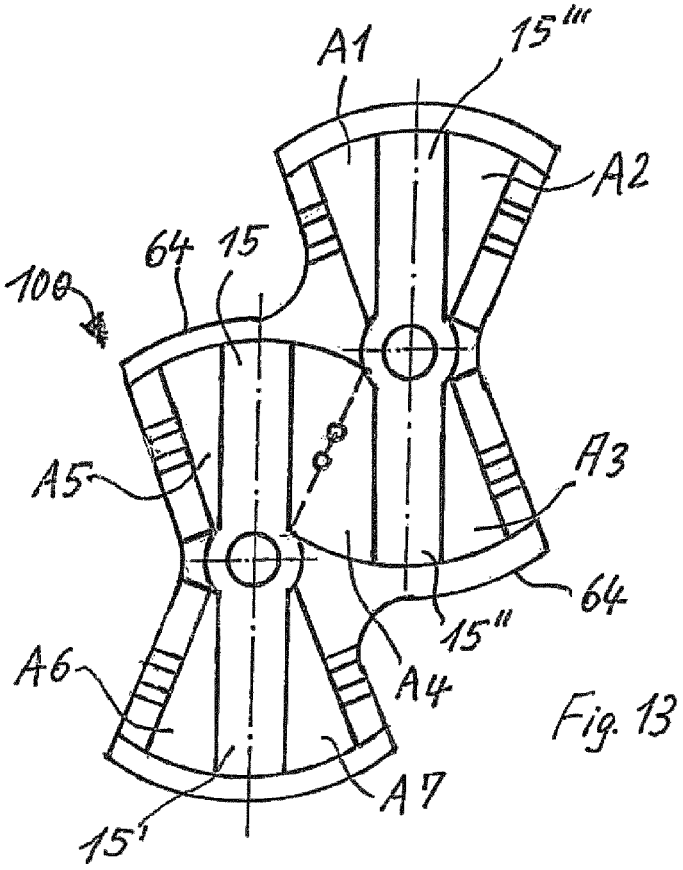
Figure 14:
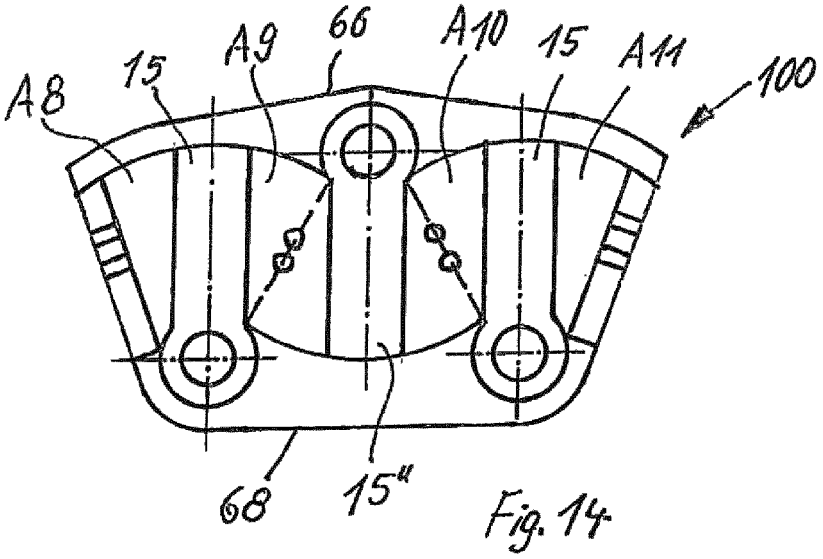
Figure 15A:
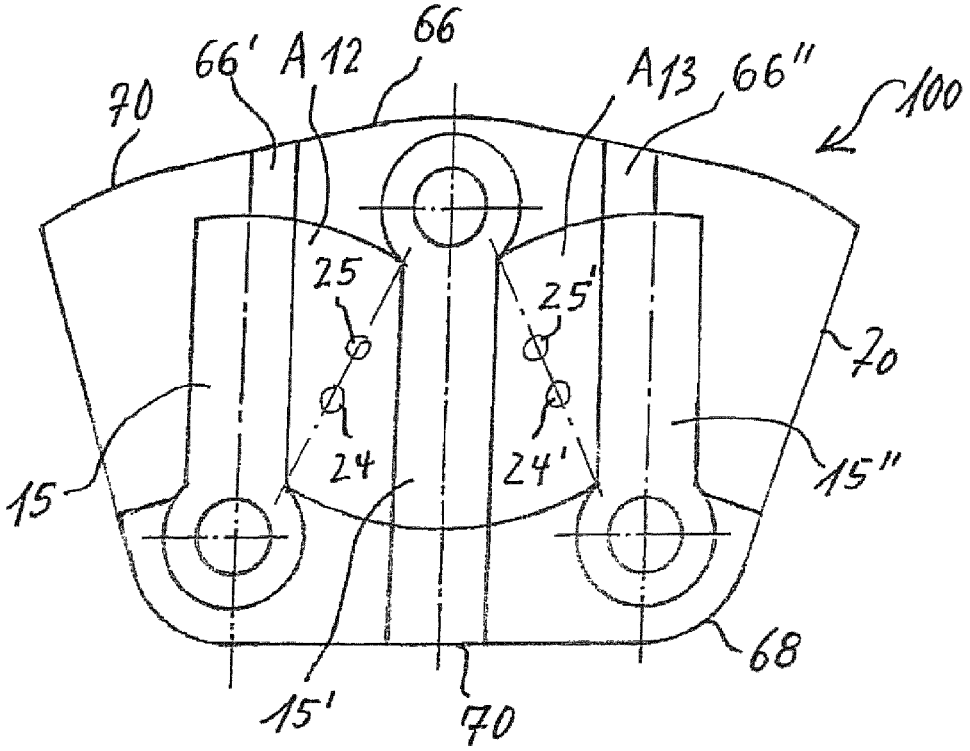
Figure 15B:
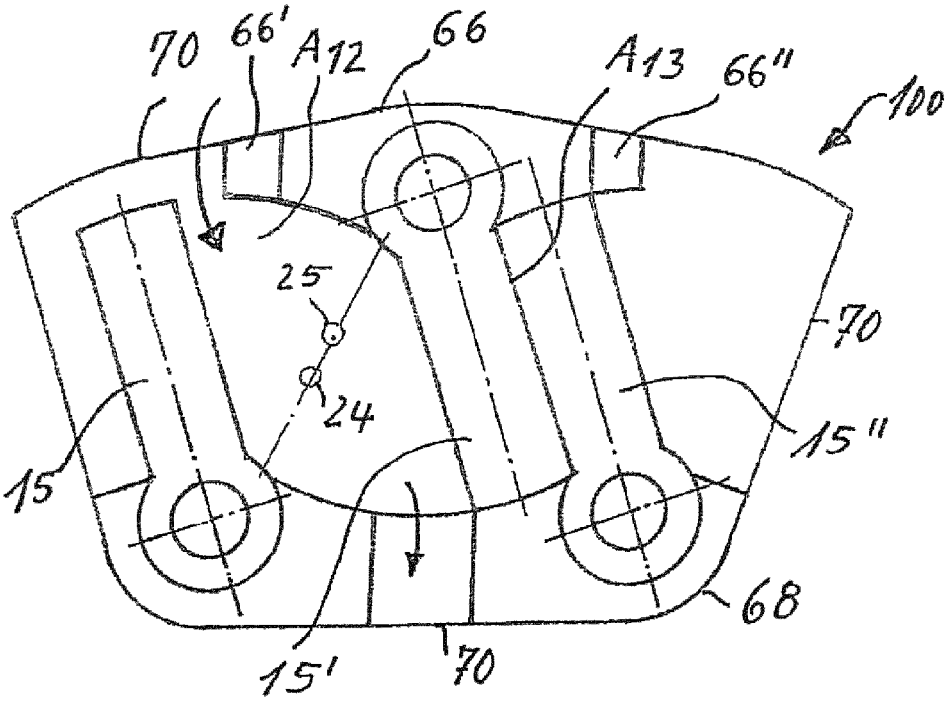

Exemplary embodiments of the invention are explained in more detail with reference to appended drawings. Shown are FIG. 1 a frontal view of a cross section of a piston machine without a loop drive according to one embodiment variant of the invention;

FIG. 2 a frontal view of another cross section of a piston machine having a loop drive according to another embodiment variant of the invention;

FIG. 3*a* a side view of the piston machine of FIG. 2 with vertical and horizontal segments;

FIG. 3*b* a perspective illustration of the piston machine of FIG. 2 with vertical and horizontal segments;

FIG. 3*c* a side view of a multi-stage piston machine according to another embodiment variant of the invention with vertical and horizontal segments;

FIG. 4 a view from above of a piston of the piston machine of FIGS. 2-3*a* with vertical and horizontal segments;

FIG. 5 a view of a cross section of another piston machine having a loop drive in the housing, with oil lubrication and a working chamber;

FIG. 6 a view of a cross section of another piston machine having a loop drive in the piston and two working chambers;

FIG. 7 a view of a cross section of a piston machine having two pistons and three chambers in a first operating state;

FIG. 8 a view of a cross section of the piston machine of FIG. 7 in a second operating state;

FIG. 9 a view of a cross section of another piston machine having two pistons, two lateral cooling apertures and only one central chamber in a first operating state;

FIG. 10 a view of a cross section of the piston machine of FIG. 9 in a second operating state;

FIG. 11 a view of a cross section of another piston machine having two pistons, two cooling apertures and three chambers;

FIG. 12*a* a view of a cross section of another piston machine having two pistons, two lateral and upper cooling apertures and one chamber in a first operating state;

FIG. 12*b* a view of a cross section of another piston machine having two pistons, two lateral and upper cooling apertures and one chamber in a second operating state;

FIG. 13 a view of a cross section of another piston machine having two dual pistons and seven chambers;

FIG. 14 a view of a cross section of another piston machine having three pistons and four chambers;

FIG. 15*a* a view of a cross section of another piston machine having three pistons, three cooling apertures and two chambers in a first operating state, and FIG. 15*b* a view of a cross section of another piston machine having three pistons, three cooling apertures and two chambers in a second operating state.

Functionally identical and recurring elements are designated with the same reference symbols in the figures.

With the invention, provision is made of a modular construction system for producing a piston machine 100. The modular construction system comprises multiple separate housing parts capable of being joined together into a housing 1 of the piston machine 100, at least one piston 15, which is configured as a pivot element, is pivotable and is able to be arranged in the housing 1, and a housing cover 7 for covering the housing 1. Various embodiments of piston machines 100 produced using the modular construction system of the invention are described in FIGS. 1-15 and in the corresponding description of the figures. For example, the piston machines known from publications DE 10 2010 036 977 B3, DE 10 2014 214 435 A1, DE 10 2008 040 574 B4 and WO 2015/173255 A1 can be produced using the modular construction system of this document.

In the following, reference shall be initially made to FIGS. 1-3. FIGS. 1-3 show an oscillating piston machine 100, which comprises a housing 1 and a gearbox housing 4. The housing 1 forms a working chamber 2, in which a piston 15 is arranged. The chamber 2 has a circular sector-shaped cross section and is delimited in a manner corresponding to the shape of a cylinder sector by two side walls 5, 6 arranged at an angle $\alpha$ of ca. 50° to 60° to each other, an end wall 10, a housing cover 7, a wall 8 having a circularly arc-shaped cross section and a rotary cylinder 9. A bearing shell 3 attaches to the ends of the side walls 5, 6 opposite the arcuate wall 8.

The rotary cylinder 9 is arranged in the bearing shell 3 in such a way that it can rotate about a swivel axis 14. A piston 15 configured as a swivel plate is fix-connected to or integrally molded on the rotary cylinder 9 such that the piston 15 can be made to swivel about the swivel axis 14, about the swivel angle $\alpha$. The piston 15, which is typically configured as a hollow body, is situated in the working chamber 2 and sealingly abuts with a top edge 26 on an inner surface of the arched circular-arc-shaped wall 8. The top edge 26 of the piston 15 is circularly arc-shaped in cross section. Inlet valves 22, 24 and outlet valves 23, 25 are formed in each case in both side walls 5, 6 of the chamber 2. A swivel movement of the piston 15 defines a swivel plane, the end wall 10 and the housing cover 7 opposite the end wall 10 being oriented parallel to the swivel plane. In a manner analogous to the piston machine 100 shown in FIG. 9, it is also possible to dispense with one or both side walls 5, 6.

The gearbox housing 4 is arranged parallel to the working chamber 2 and to the piston 15 and also parallel to the housing cover 7 and to the end wall 10. A swivel lever 16, which has a guide slot or loop 17 extending over the length thereof, is arranged in the gearbox housing 4. A crankpin 18 of a crankshaft 19 mounted rotatably in the gearbox housing 4 engages in the loop 17. The drive can also be designed differently.

FIG. 5 shows a view of a cross section of another piston machine 100, which was produced using the modular construction system. The piston machine 100 of FIG. 5 differs from the piston machine 100 shown in FIGS. 1-3 only in that the gearbox housing 4 attaches to the bearing shell 3 in a radial direction rather than adjoining the housing cover 7. The gearbox housing 4 has an oil sump 12 for lubricating the crank mechanism, i.e., the loop 17 and the crankpin 18 sliding therein. The working chamber 2 is hermetically sealed with respect to the gearbox housing 4 by means of sealing strips 13 integrated in the bearing shell. The piston 15 and the swivel lever 16 are rigidly attached diametrically opposite each other to the rotary cylinder 9.

FIG. 6 shows still another embodiment of a piston machine 100 produced using the modular construction system and configured with two working chambers 2 extending oppositely from the rotary cylinder 9. The dual piston swivel plates 15, 15' associated with each working chamber 2 and driven synchronously in respectively opposite directions are mounted opposite one another on the rotary cylinder 9. The connecting rod 16 is an integral component of the piston 15' configured with a loop 17 (guide slot), which rod has a correspondingly greater thickness and thus also a correspondingly larger dimensioning of the working chamber 2', as FIG. 6 shows. The drive can also be designed differently.

The housing 1 and the piston 15, 15' of the piston machines 100 described above can be made of diverse materials such as a metal, a ceramic material or a plastic.

The piston machines 100 described above can operate as reciprocating pumps or reciprocating compressors, as follows, and can also function as compressed-gas motors, which are not described in the function here:

During the rotary movement of the crankshaft 19, the crankpin 18 slides in the loop 17 of the swivel lever 16, which thus executes a swivel movement and transmits this swivel movement to the piston 15, 15'.

As the piston 15 swivels from the position shown in FIG. 1, 5 or 6 at the left side wall 5 of the chamber 2 to the right side wall 6, the left inlet valve 22 and the right outlet valve 25 are opened, whereas the left outlet valve 23 and the right inlet valve 24 are closed. A previously aspirated fluid is thus expelled from the chamber 2 via the right outlet valve 25. On the other side, a working fluid is aspirated via the left inlet valve 22 and then expelled as the piston continues to swivel with the left inlet valve 22 closed and the left outlet valve 23 open, whereas on the right side, fluid is aspirated via the inlet valve 24. The piston 15 therefore operates as a dual piston with two working surfaces 129 and 130.

Alternatively, provision can be made such that, for example, the crankpin 18 of the crankshaft 19 engages in a connecting rod eye of a swivel lever articulatingly connected to the piston 15. However, use can also be made of alternative drives or outputs. The drive or output of the piston machine 100 is thus not limited to the illustrated embodiments.

For the operating principle of the piston machines 100 of FIGS. 1-6, reference is also made by way of example to publications DE 10 2010 036 977 B3, DE 10 2014 214 435 A1, DE 10 2008 040 574 B4 and WO 2015/173255 A1, which are made part of the present document.

According to one embodiment of the invention, the housing 1 of the piston machine 100 comprises at least two separate, interconnected housing parts.

In FIG. 1, it is indicated that the side walls 5, 6, the bearing shell 3, the arcuate wall 8 and the end wall 10 form separate housing parts, which are assembled into the housing 1 shown in FIG. 1. Also, the arcuate wall 8, the side walls 5, 6 and the bearing shell 3 are each of multi-part construction. Accordingly, the arcuate wall 8 can have a plurality of wall parts 28, the side walls 5, 6 can each have a plurality of side wall parts 29 and the bearing shell 3 can have a plurality of bearing shell parts 30. In a preferred embodiment, the number of wall parts 28, the number of side wall parts 29 and the number of bearing shell parts 30 are equal. As indicated in FIGS. 3*a* and 3*b*, the wall parts 28, the side wall parts 29 and the bearing shell parts 30 is able to be arranged in sequence in the manner of discs in an axial direction.

In the exemplary embodiment of FIGS. 1 to 4, the arcuate wall 8 has three separate wall parts 28, the side wall 5 comprises three separate side wall parts 29, the side wall 6 comprises three separate side wall parts (not illustrated) and the bearing shell 3 comprises three separate bearing shell parts 30. As can be discerned from FIGS. 3*a* and 3*b*, the wall parts 28, the side wall parts 29 and the bearing shell parts 30 are each arranged along the swivel axis 14 in an axial direction. Accordingly, 12 individual housing parts are situated between the housing cover 7 and the end wall 10.

Overall, the housing 1 of the piston machine 100 thus comprises three wall parts 28, six side wall parts 29 (each side wall 5 and 6 having three), three bearing shell parts 30 and an end wall 10 such that the housing 1 is constructed from 13 interconnected individual parts. The number of housing parts used can vary in different embodiments and is in particular not limited to 13.

Due to the modular construction of the housing 1, individual housing parts can be economically produced and replaced as needed. Furthermore, a volume of the housing 1, in particular a volume of the chamber 2, can be reduced or enlarged by omitting or by adding housing parts, respectively.

According to one embodiment, the piston 15 furthermore has at least two interconnected piston parts 20.

In one embodiment, the number of piston parts 20 is equal to the number of wall parts 28, the number of side wall parts 29 and/or the number of bearing shell parts 30; the number of piston parts 20 being three in the exemplary embodiment shown in FIGS. 1-3. The number of piston parts 20 can also be less than or greater than three. A volume of the chamber 2 can be modified by varying the number of piston parts 20 and/or housing parts.

The left inlet valve 22, the left outlet valve 23, the right inlet valve 24 and the right outlet valve 25 can also be discerned in the perspective illustration of the piston machine of FIG. 3*b*. It can furthermore be discerned that the housing cover is formed by the segments 7, 7', 7", which extend vertically in sequence. Moreover, the arcuate wall, which is arranged on the top side and in which the valves 22, 23, 24 and 25 are inserted, is subdivided axially and horizontally into 3 segments in each case. The same applies to the bearing shell 3, which is subdivided axially into three segments 30 in each case. The (right) side wall is subdivided into 3 segments arranged axially in sequence and into 3 segments arranged vertically in sequence, in other words into 9 segments in total; segments arranged vertically in sequence being designated with the reference symbols 6, 6' and 6". The same applies in analogous manner to the left side wall 7 not shown in FIG. 3*b*.

FIG. 3*c* shows a side view of a piston machine according to an alternative embodiment variant of the invention. The piston machine of the embodiment variant of FIG. 3*c* essentially corresponds to the piston machine according to the embodiment variant of FIGS. 1 to 3*b*. However, the piston machine of the embodiment variant of FIG. 3*c* comprises multiple compressor stages 71, 71' and 71", which each correspond to separate side walls 6, 6' and 6" with different vertical extensions, whereas the separate side walls 29 of the piston machine according to the embodiment variant of FIGS. 1 to 3*b* are each equal in size (vertically).

According to the embodiment variant of FIG. 3*c*, in particular the vertical extensions of the side walls 6, 6', 6" arranged axially in sequence differ from one another. It is thus preferred if the vertical extension of the side walls 6, 6', 6" along the axis 14, preferably from the end wall 10 to the cover 7, diminishes with each segment 6, 6', 6".

Because the piston machine according to the embodiment variant of FIGS. 1 to 3*b* can easily be converted to the piston machine of the embodiment variant of FIG. 3*c*, the advantage of the modular construction is obvious.

A view of a longitudinal section of the piston 15 and of the rotary cylinder 9 of FIGS. 1 to 3 is shown in FIG. 4. In FIG. 4, it can be discerned that the piston 15 has three piston parts 20, which are interconnected to form the piston 15. The rotary cylinder 9 also has rotary cylinder parts 21, which are each connected to the piston parts 20. The rotary cylinder parts 21 are fastened to one another in a disc-like manner and jointly form the rotary cylinder 9. The swivel axis 14 is also indicated in FIG. 4. The piston parts 20 and the rotary cylinder parts 21 are arranged axially in sequence along the swivel axis 14. In another embodiment, each piston part 20 comprises a plurality of radial piston parts 31 arranged in a radial direction; the radial piston parts 31 are indicated by dashes in FIG. 3*a*.

The housing parts, the piston parts 20 and the rotary cylinder parts 21 have means such as pins, tongue-and-groove connections or the like for joining, fastening and fixing the components. In addition or as an alternative to said connection methods, the piston parts 20 and/or housing parts can be bonded, welded or soldered together. To this end, the piston parts 20, rotary cylinder parts 21 and/or housing parts can have designated welding points, bonding points or soldering points.

In comparison to the piston machines 100 of FIGS. 1-5, the piston machines 100 depicted in FIGS. 7-15 have at least one further piston 15", which is configured as a swivel element, is pivotable and arranged in the housing 1. The pistons 15 and 15" are driven synchronously and in parallel, opposite directions in each case, and a swivel axis 14' of the piston 15" runs parallel to the swivel axis 14 of the piston 15.

For the method of operation of the multi-piston piston machine of FIGS. 7-15, reference is made to, for example, publications DE 10 2010 036 977 B3 and WO 2015/173255 A1, wherein the disclosed content of these publications is made part of the present application. In order to avoid redundancy, features that have already been explained in conjunction with the piston machines 100 of FIGS. 1-6 shall not be discussed in any further detail in the following. Features of the piston machines 100 of FIGS. 1-6 can be combined with the features of the piston machines of FIGS. 7-15 and vice versa.

As in the embodiments of FIGS. 1-6, the housing 1 of the piston machines of FIGS. 7-12 is in multi-part form, i.e., the housing 1 comprises multiple interconnected housing parts.

In addition to the housing parts mentioned above, the housing 1 can comprise a bearing shell 3', a side wall 5', a arcuate wall 8', a rotary cylinder 9', an inlet valve 22', an outlet valve 23', an inlet valve 24' and/or an outlet valve 25', inter alia.

The arcuate wall 8' and the bearing shell 3 are configured as a first chamber head section 60. In addition, the arcuate wall 8 and the bearing shell 3' are configured as a second chamber head section. The chamber head sections 60, 62 comprise multiple one-piece discs, which are arranged axially in sequence in a manner analogous to that of the wall parts 28, the side wall parts 29 and the bearing shell parts 30 of FIG. 3*a*. The number of axial discs of a chamber head section 60, 62 is exactly equal to the number of piston parts 20. As can be discerned in the figures, the two chamber head sections 60, 62 can have the same shape.

Like the piston 15 or the rotary cylinder 9, the piston 15" or the rotary cylinder 9' can also be in multi-part form. For the details of the multi-part piston 15" and of the multi-part rotary cylinder 9', reference is made to FIG. 4 and to the corresponding description above.

In comparison to the piston machine of FIGS. 7-8, the piston machines 100 of FIGS. 9 to 12*b* have cooling apertures 70 in the housing 1 for convectively cooling the piston or the housing 1. The cooling aperture 70 can be a gap in the housing 1, which extends in an axial direction. To form the cooling aperture 70 or the gap, housing parts can be spaced apart from one another. Accordingly, the piston machine shown in FIG. 11 comprises chamber head sections 60 or 62 and arcuate walls 8' or 8 spaced apart therefrom; the cooling apertures 70 being arranged between the chamber head section 62 and the wall 8 or between the chamber head section 60 and the wall 8'. The piston machines 100 shown in FIGS. 1, 5 and 6 can optionally also have one or multiple cooling apertures.

According to the embodiments of FIGS. 9, 10 and 12*b*, the cooling aperture can also be formed by omitting at least one of the side walls. Accordingly, the side walls 5 and 5' were dispensed with in the embodiment of the piston machine 100 of FIGS. 9 and 10 in order to form cooling apertures 70 and to cool the pistons 15 and 15" laterally. A working medium enters the working chamber via the inlet valve 24' and is expelled via the outlet valve 25'.

As can be discerned from FIGS. 12*a* and 12*b*, the pistons 15 and 15" move between a first position, in which the pistons 15 and 15" are at a minimum distance from each other, but without contact, and a second position, in which the pistons 15 and 15" are at a maximum distance from each other. The piston machine is configured in such a way that the pistons 15 and 15" are always offset by 180° in relation to each other.

Further details on the cooling apertures 70 are described in publication WO2015/173255 A1, of which the disclosed content is made part of the present document.

Two further examples of piston machines 100 having four pistons 15, 15', 15", 15''' (FIG. 3*a*) or having three pistons 15, 15' (FIG. 4), respectively, are shown in FIGS. 13 and 14. The piston machine 100 of FIG. 13 is a combination of the piston machines 100 of FIGS. 6 and 7. The piston machine 100 of FIG. 14 represents an upgrade of the piston machine 100 of FIG. 7. The piston machines 100 of FIGS. 13 and 14 make it possible to create multiple working chambers A1, A2, A3, A4, A5, A6, A7, A8, A9, A10, A11, which can each operate simultaneously as pumps, compressors, compressed-gas motors and/or expansion motors. The pistons 15, 15', 15" and 15'" can have different lengths, which makes it possible to provide working chambers A1, A2, A3, A4, A5, A6, A7, A8, A9, A10, A11 having different sized volumes. The piston machines can thus be operated as, e.g., multi-stage compressors or multi-stage vacuum pumps. Furthermore, the working chambers A1, A2, A3, A4, A5, A6, A7, A8, A9, A10, A11 of the piston machines 100 of FIGS. 13 and/or 14 can each be different sizes in an axial direction.

As can be discerned in FIGS. 13 and 14, different housing parts can be combined into single parts. Accordingly, a side wall part, a arcuate wall and a part of a bearing shell are assembled into a housing part 64 in FIG. 13. In FIG. 14, two arcuate walls and a bearing shell are combined into a housing part 66. Also in FIG. 14, two bearing shells and a arcuate wall are joined into a housing part 68. The housing parts 64, 66, 68 can each have multiple interconnected discs in an axial direction.

FIGS. 15*a* and 15*b* show a view of a cross section of a further piston machine having three pistons, three cooling apertures, and two chambers with different positions of the pistons 15, 15' and 15" in each case.

The piston machine 100 has three pistons 15, 15' and 15", which jointly form two working chambers A12 and A13 with the housing parts 66, 68 and the three cooling apertures 70. In a first work step starting from the piston positions of FIG. 15*b*, the pistons 15 and 15' move toward each other in order to compress the working chamber A12 with the inlet valve 24 and the outlet valve 25.

In this step, the piston 15", starting from the piston positions of FIG. 15*b*, swivels away from the piston 15' (i.e., outwardly to the right) such that in a neutral position (FIG. 15*a*), the bottom cooling aperture 70 is briefly closed by the piston 15' and the right cooling aperture 70 and the left cooling aperture 70 are also closed by the pistons 15 and 15', respectively. The pistons 15 and 15' then continue to swivel towards each other such that they have a minimum distance from each other (end position opposite the end position of FIG. 15*b*, not illustrated). In this process, the bottom cooling aperture 70 and the right (or left) cooling aperture 70 are opened (end position of FIG. 15*b* or opposite end position—not illustrated). The working chamber A12 can thus be cooled in a particularly effective manner during the compression of the working chamber A13 (FIG. 15*b*) or conversely, the working chamber A13 can be cooled in a particularly effective manner during the compression of the working chamber A12 (not illustrated). It is thus possible to dispense with additional cooling means (e.g., active cooling systems).

The piston machines disclosed in the preceding were described according to an aspect of the invention as multi-part piston machines, i.e., the working chamber is formed by a plurality of housing parts. However, according to another aspect of the invention it is possible for all of the piston machines disclosed herein to have a one-piece working chamber. Although it may not be possible to produce the latter using the modular construction system explained herein, these piston machines can achieve the other advantages disclosed in the application.

The invention also provides a method for producing the piston machines 100 shown in FIGS. 1-15. The method comprises at least the following steps:

- Provision of at least two separate interconnectable housing parts,
- Provision of at least two separate interconnectable piston parts 20, 31,
- Provision of a housing cover 10,
- Joining of said housing parts into a housing 1,
- Arrangement of the piston parts 20, 31 in the housing 1,
- Formation of a piston 15, which is configured as a swivel element, is pivotable and arranged in the housing 1, by means of the piston parts 20 and
- Closing of the housing 1 by means of the housing cover 10 in order to form the piston machine 100.

Additional steps may be added in order to produce the specific features of the piston machines 100 shown in FIGS. 1-15.

LIST OF REFERENCE NUMERALS

1 Housing
2 Chamber
3 Bearing shell
3' Bearing shell
4 Gearbox housing
4' Gearbox housing (segment)
4" Gearbox housing (segment)
5 Left side wall
5' Side wall
6 Right side wall
6' Right side wall
6" Right side wall
7 Housing cover
7' Housing cover (segment)
7" Housing cover (segment)
8 arcuate wall
8' arcuate wall
9 Rotary cylinder
9' Rotary cylinder
10 End wall
10' End wall
10" End wall
11 Crank radius
12 Oil sump
13 Sealing strip
14 Swivel axis
14' Swivel axis
15 Piston
15' Piston
15" Piston
15'" Piston
16 Swivel lever
17 Loop
18 Crankpin
19 Crankshaft
20 Piston part
21 Rotary cylinder part
22 Left inlet valve
22' Inlet valve
23 Left outlet valve
23' Outlet valve
24 Right inlet valve
24' Inlet valve
25 Right outlet valve
25' Outlet valve
26 Top edge of the piston

27 Shaft
28 Wall part
29 Side wall part
30 Bearing shell part
31 Piston part
60 Chamber head section
62 Chamber head section
64 Housing part
66 Housing part
68 Housing part
70 Cooling aperture
71 Compressor stage 1
71' Compressor stage 2
71" Compressor stage 3
100 Piston machine
129 Working surface
130 Working surface
α Swivel angle
A1 Working chamber
A2 Working chamber
A3 Working chamber
A4 Working chamber
A5 Working chamber
A6 Working chamber
A7 Working chamber
A8 Working chamber
A9 Working chamber
A10 Working chamber
A11 Working chamber
A12 Working chamber
A13 Working chamber

The invention claimed is:

1. An oscillating piston machine with a modular construction, comprising:

a piston, a housing with a working chamber with at least one inlet opening and at least one outlet opening, wherein the piston is mounted in a manner capable of swivelling about a swivel axis in the working chamber, the swivel axis defining an axial direction;

wherein the piston is operatively connected to at least one rotatably mounted shaft;

wherein the working chamber is formed by a plurality of housing parts as well as a housing cover and an end wall, wherein the housing parts have, in a plane perpendicular to the swivel axis, at least two separate side walls for delimiting the working chamber, and, wherein the housing parts have at least two additional separate side walls that are arranged successionally in the direction of the swivel axis and in a plane parallel to the swivel axis; and wherein the housing cover and the end wall are each formed by at least two separate segments which are each arranged in sequence in a vertical direction extending between an arcuate wall and a bearing shell, and wherein the arcuate wall is formed by at least two separate segments, which are each arranged axially in sequence.

2. The piston machine of claim 1, wherein the working chamber is delimited on a front side by the housing cover and on the back side by the end wall in relation to the swivel axis, on a top side by the arcuate wall and on a bottom side by the bearing shell in relation to the swivel axis, wherein the at least two separate side walls and the at least two additional separate side walls extend between the housing cover, the end wall, the arcuate wall, and the bearing shell.

3. The piston machine of claim 1, wherein the piston machine is configured as a multi-stage piston machine, wherein provision is made of multiple compressor stages, wherein the vertical extensions of the at least two separate side walls and the at least two additional separate side walls configured axially in sequence of each compressor stage differ from one another.

4. The piston machine of claim 1, further comprising a second piston within the working chamber, wherein the two pistons, which are designed to be pivotable, are capable of swivelling between a first position, in which the pistons are arranged at a minimum distance to each other, but without contact, and a second position, in which the pistons are at a maximum distance from each other, wherein the pistons are offset by 180°.

5. The piston machine of claim 4, wherein at least two cooling apertures are provided in the common working chamber in such a way that the two cooling apertures are open in the second position.

6. The piston machine of claim 1, wherein the at least two separate side walls are identically constructed.

7. The piston machine of claim 1, wherein the working chamber is delimited transversely with respect to the swivel axis by the bearing shell, the two separate side walls and the arcuate side wall.

8. The piston machine of claim 1, wherein the at least two separate side walls and the at least two additional separate side walls delimiting the cross-section of the working chamber perpendicular to the swivel axis are each formed by a plurality of identical side wall portions, which are arranged axially in sequence.

9. The piston machine of claim 1, wherein the at least two separate side walls are detachably interconnected.

10. The piston machine of claim 1, wherein the at least two separate side walls and the at least two additional separate side walls are arranged symmetrically to a plane which extends perpendicularly to the swivel axis and along a longitudinal axis of the piston in a neutral position.

* * * * *